US007261259B2

(12) United States Patent
Little et al.

(10) Patent No.: US 7,261,259 B2
(45) Date of Patent: Aug. 28, 2007

(54) FLARED RAILWAY FROG

(76) Inventors: Michael R. Little, 38135 Zuspan Rd., Middleport, OH (US) 45760; Brett Michael Little, 1354 Adamsville Rd., Bidwell, OH (US) 45614

( * ) Notice: Subject to any disclaimer, the term of this patent is extended or adjusted under 35 U.S.C. 154(b) by 85 days.

(21) Appl. No.: 10/966,699

(22) Filed: Oct. 15, 2004

(65) Prior Publication Data

US 2006/0081734 A1 Apr. 20, 2006

(51) Int. Cl.
*E01B 7/00* (2006.01)

(52) U.S. Cl. ..... 246/472; 246/468

(58) Field of Classification Search ..... 246/468, 246/469, 472, 463, 460, 458, 456, 275, 274, 246/454

See application file for complete search history.

(56) References Cited

U.S. PATENT DOCUMENTS 1,391,226 A * 9/1921 Weaver ..... 246/471
1,402,098 A * 1/1922 Shaw ..... 246/468
2,377,273 A * 5/1945 Siebert ..... 246/275
3,764,802 A * 10/1973 Webster ..... 246/468

* cited by examiner

*Primary Examiner*—Mark T. Le
(74) *Attorney, Agent, or Firm*—Porter Wright Morris & Arthur, LLP

(57) ABSTRACT

An improved railway frog having opposite side flangeways, each flangeway comprising a channel with an ending width greater than a corresponding channel width of a conventional frog. The improved frog channel further comprising a first segment and a second segment. The second segment having an outside wall angled greater than a corresponding first segment outside wall in relation to an inner wall of the channel.

10 Claims, 4 Drawing Sheets

FLARED RAILWAY FROG

FIELD OF THE INVENTION

The present invention relates to rail crossings and turnouts and more specifically to an improved frog particularly suitable for mine use.

BACKGROUND OF THE INVENTION

Rail crossings and turnouts are points where two sets of track cross. The center part of the crossing is sometimes referred to as a frog. Frogs can be cast or fabricated. For heavy use, frogs are sometimes formed from a durable steel such as manganese to increase resistance to wear and impact. Manganese frogs are a standard part of the mining, tunneling and railroad industry.

The rails connecting the switch rails to the frog are called closure rails. A frog has a toe end connected to the closure rail and a heel end at the end of a frog furthest from the switch. The frog point is the area where the running edges of two crossing rails come together. The frog has wing rails, which are two small rails at the heel end of the frog running essentially parallel to the wheel path along each side of the frog point. The wing rails support the wheel of the train car as the wheel crosses the gap at the frog point. The wing rails and the point define an X-shaped pair of grooves or flangeways. The flangeway is a channel that allows the wheel flange of the car to pass. The flangeway allows the wheel flange to maintain continuous contact with the inner surfaces of the frog through the intersection of the rails.

In order to properly guide a passing car over the frog, a guard-rail is typically placed on the opposite rail. A short rail is placed inside of and parallel to the stock rail opposite the point that the wheels pass through the frog.

The width of the frog is called its spread. Different sized frogs are used for rails making various angled turns. Frogs are generally identified by a frog number, which corresponds to the ratio of the length to the sum of heel and toe spreads. Conventional frogs have standard dimensions according to the frog number. Larger numbered frogs are generally used for larger turn radii.

The mining industry presents challenges for rail crossings. Modern mining cars are longer than their predecessors are. Most mine car wheels are fixed and do not turn. Due to the tight curves in the rails in mining operations, the wheels of these longer rail cars cannot follow the turns easily and easily derail when passing through a frog. As the leading wheels of the car move through the frog to the secondary rail, the car is turned in a different direction from that of the original rail. The fixed rear wheels of the car are pushed to the outside of the turn. In an existing frog, the rear wheel may jump the frog and derail the car. Where cars derail, damage may occur to the car and or the load in the car and the impact of the train car wheels on the frog generates early failure of the crossing.

Wing rails and guard rails have been used in an attempt to prevent derailing; however, no frog exists that adequately prevents derailing of longer fixed-wheel cars, such as those used in mines. A need exists for a frog having the ability to maintain the rear wheels of a car and successfully transfer the car through a turnout or crossover on a track. A need exists for a frog with a flangeway having an adequate width and angle to allow the wheel of a train car riding the wing rail across the intersection to stay in contact with the frog until it is supported by the secondary rail.

SUMMARY OF THE INVENTION

The present invention addresses these needs and relates to an improved frog having flared segments in each of two opposite flangeways. The improved frog varies in size and turn radius corresponding generally to known frog numbers. Although the frog's dimensions vary by frog number, the ending width of the flangeway is proportionally greater than a corresponding ending flangeway width of a conventional frog.

The frog has an upper surface for supporting a rail car wheel. The flared flangeway comprises a channel that allows a wheel flange of a railway car to pass through the frog. A segment of the flangeway angles away from a point section at a greater angle than that of similar segments of conventional frog flangeways. In an embodiment, the segment's ending width is approximately 3.5 times greater than the beginning width.

Each segment tapers outwardly from a center line of the frog to form a generally triangular perimeter. Together the segments form a generally triangular perimeter. In an embodiment, the angle of the segment wall forms about a 25 degree or about a 30 degree angle with the center line or the point wall. The segments together form about a 50 degree to about a 60 degree angle. In an embodiment having a certain frog number, the ending width of each channel is approximately 5.5 inches.

The present invention's construction comprises walls that are thicker than corresponding walls of conventional frogs. In comparison to conventional frogs, the present invention comprises additional steel in cavities to increase strength and durability. In an embodiment, the frog is unitarily formed of steel, preferably manganese.

The present invention comprises a method for providing an improved rail way frog comprising forming the frog into a predetermined shape having a predetermined length and a predetermined width with thicker walls than corresponding walls of conventional frogs. The improved frog of the present invention is formed with opposite flangeway channels having an ending width greater than a corresponding ending width of a channel in a conventional frog.

These improvements offer enhanced performance over conventional frogs, resulting in a savings of time and expense by rail operators and owners, particularly mines owners and their employees.

Features, aspects, advantages and objects presented and accomplished by the present invention will become apparent and or be more fully understood with reference to the following description and detailed drawings of preferred and exemplary embodiments.

DETAILED DESCRIPTION OF THE INVENTION

Figure 1:
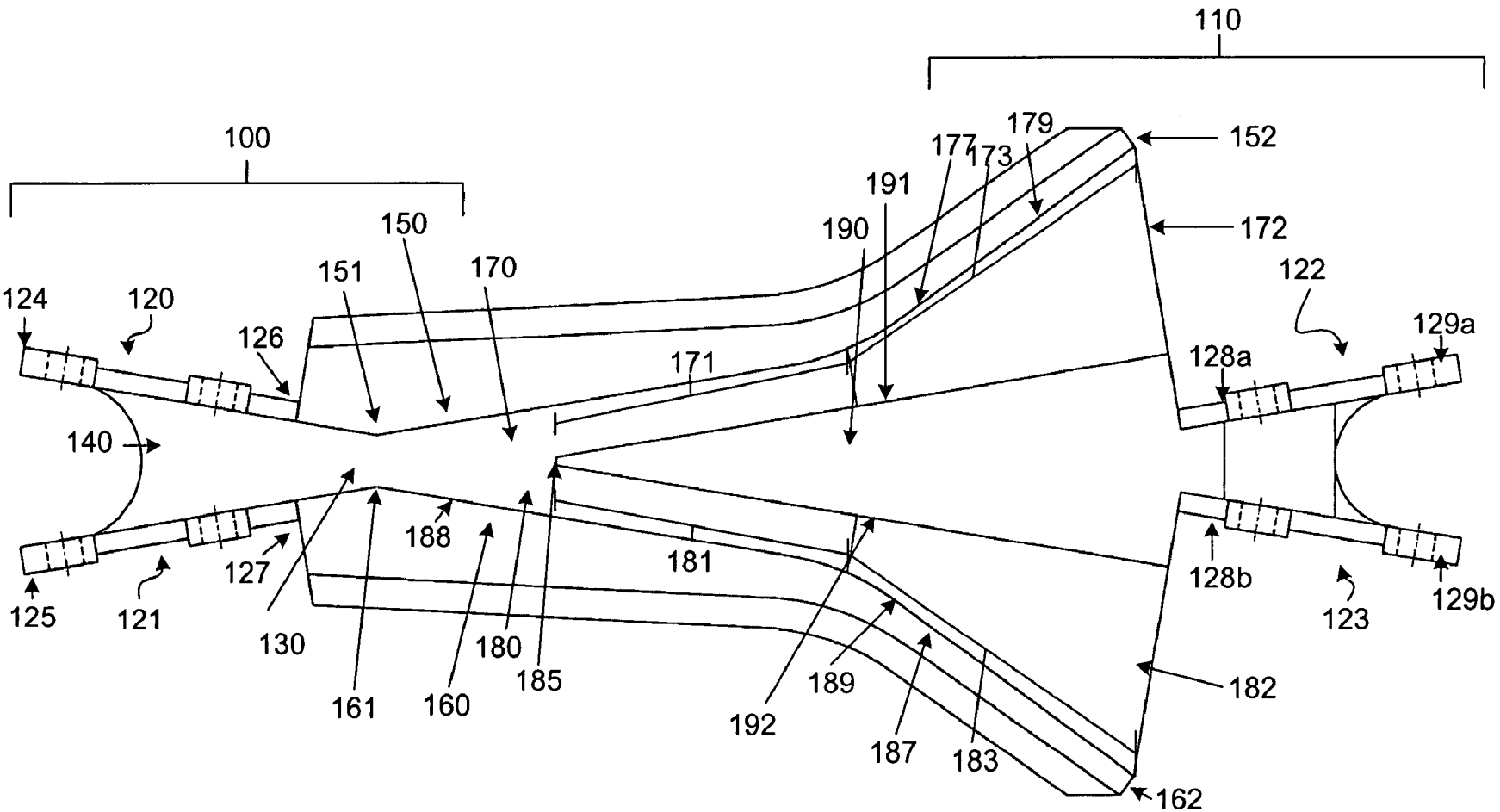
FIG. 1 is a top view of the frog.

As shown in FIG. 1, the frog comprises substantially mirrored portions extending from a centered horizontal line. The frog comprising a toe end 100 and a heel end 110. The toe end 100 comprises toe end connectors 120, 121 that connect the frog to a first set of tracks, and the heel end 110 comprises heel end connectors 122, 123 that connect the frog to a second set of tracks. The far ends 124, 125 of each of the toe end connectors 120, 121 are farther apart than the near ends 126, 127 of each toe end connector 120, 121. The near ends 126, 127 of the toe end connectors 120, 121 converge to a set distance at the throat 130 of the frog. A toe ramp 140 extends from a middle portion of the toe end connectors 120, 121 to the throat 130 of the frog. The toe ramp 140 extends between the toe end connectors 120, 121 from near the bottom of each inside wall of each toe end: connector 120, 121 to the throat 130. The end of the toe ramp 140 at the throat 130 is in a higher plane than the end of the toe ramp 140 at the middle portion of the toe end connectors 120, 121.

The frog comprises a left wing rail 150 and a right wing rail 160 that generally mirror each other and extend from the throat 130. The distance between the throat ends 151, 161 of the wing rails 150, 160 is less that the distance of the opposite ends 152, 162 of the wing rails 150, 160.

The toe ramp 140 cooperates with flangeways 170, 180. The flangeways 170, 180 are joined prior to point 185 and formed from the sides of the wing rails 150, 160. The flangeways 170, 180 diverge after the point 185 and each extend outwardly toward the heel end 110. A point section 190 extends between flangeways 170, 180. Lateral side walls of the point section 190 form each flangeway's second wall 191, 192. The point section 190 is essentially triangular shaped and terminates at the heel end connector near ends 128*a*, 128*b*. Each heel end connector near end 128*a*, 128*b* is closer to the other than each heel end connector far end 129*a*, 129*b*.

The flangeways 170, 180 angle outward as compared to each other. Ends of a flangeway first segment 171, 181 at the throat 130 are closer in proximity to each other than the segment opposite end. The first segment wing rail side wall 178, 188 and the point side wall 191, 192 are approximately parallel to each other. A second flangeway segment 173, 183 has a second segment wing rail side wall 179, 189 at a greater angle to that of the side wall of the first flangeway segment 171, 181 in reference to the point side wall 191, 192. In an embodiment, the angle of the second segment side wall 179, 189 to the point side wall 191, 192 is approximately 25 degrees to approximately 30 degrees. In a preferred embodiment, each second flangeway segment wing rail side wall 179, 189 angles from the respective point side wall 191, 192 at about a 28 degree angle. In an embodiment, the segment side walls 179, 189 form about a 50 degree to about a 60 degree angle to each other. In a preferred embodiment, the angle formed by the second segments is about a 56 degree angle.

In an embodiment, a flangeway second segment end 172, 182 width is approximately 3 to 4 times greater than a beginning width closest to first segment. In a preferred embodiment, the width of each flangeway end 172, 182 is about 3.5 times greater than end closest to the first segment.

One skilled in the art would readily understand that the size and angles of the present invention vary to conform to the pattern and dimensional details of the rail and the radius of the curve. The present invention varies in size, generally corresponding to the size of conventional frogs based on frog numbers.

Figure 2:
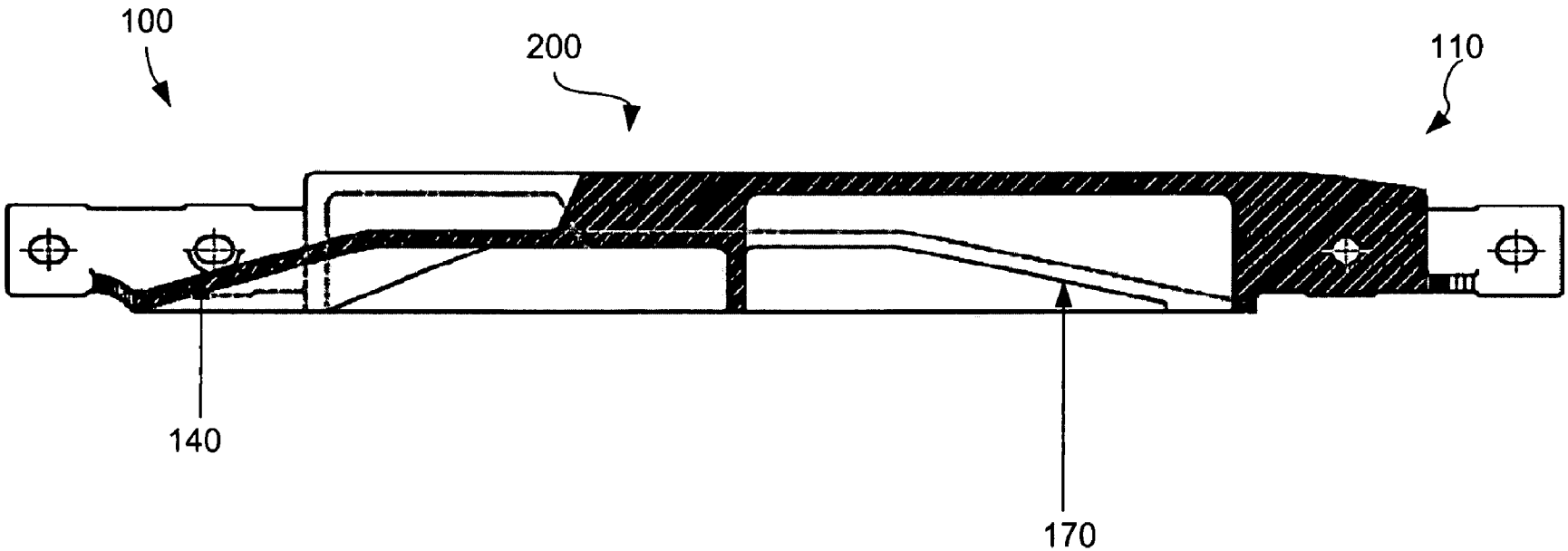
FIG. 2 is a cross sectional side view of the frog.

In FIG. 2 and FIG. 3, only one side of the frog is shown, however, one skilled in the art would readily understand that mirror images of the figures would describe the other half of the frog. As shown in FIG. 2, the upper surface 200 of the frog is essentially flat. The general slope of the toe ramp 140 is illustrated in FIG. 2. The flangeways 170, 180 are also ramped downward toward the heel end 110 and deep enough to provide sufficient clearance to allow the flange of a wheel of a car to pass without contacting the bottom of the frog.

FIG. 3 depicts cross-sectional views of the frog as it conforms to the rails. Only one half of the frog is shown, however, one skilled in the art would readily understand that mirror images of the figures would describe the other half of the frog. FIG. 3A depicts the frog in relation to the rail at the toe end connectors 120, 121. The frog is secured to the rail by means 310 of bolting, riveting, fastening, welding, and the like. FIG. 3B depicts the the ramp 140 in relation to the rail. The frog is secured 320 to the rail in a similar fashion as in FIG. 3A at this sector. FIG. 3C depicts the side wall of the ramp 140 in cooperation with the throat 130 and wing rails 150, 160.

Figure 3A:
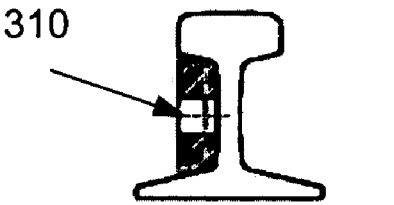
FIG. 3 depicts cross-sectional views of the frog at various points in connection with the rail.
Figure 3B:
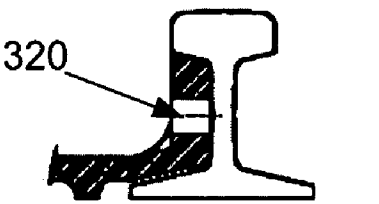
Figure 3C:
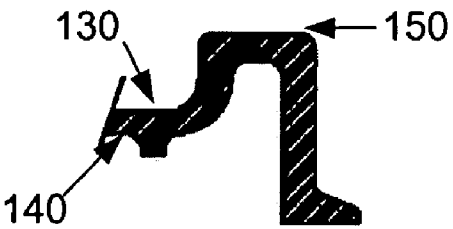
Figure 3D:
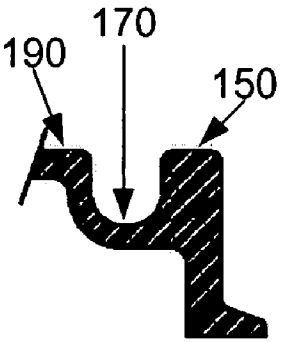
Figure 3E:
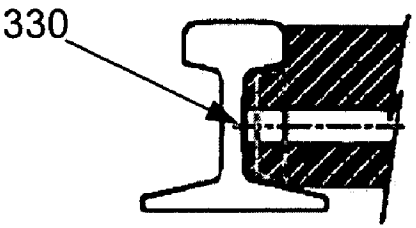
Figure 3F:
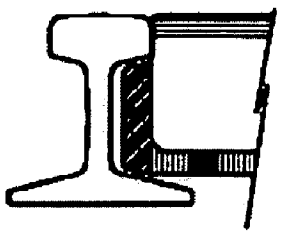

FIG. 3D depicts the wing flangeway 170, 180, in conjunction with the wing rail 150, 160 and the point section 190 at the flangeway first segment 171, 181. FIG. 3F shows the relationship of the improved frog to the second rail at the heel end connector far end 129*a*, 129*b* just prior to the connection to the second rail. The heel end connector 122, 123 is secured 330, 340 (see FIG. 4) to the second rail by means of bolting, riveting, fastening, welding, and the like.

The improved frog of the present invention is cast of steel, preferably, manganese steel. As depicted in FIGS. 3A–F, the wall thickness of the improved frog is thicker than conventional frogs. As shown in FIGS. 3E and 3F, the structure of present invention from about the heel end connector near end 128*a*, 128*b* to about the point 185 of the frog is not hollowed as found in conventional frogs, but is solid steel. In an embodiment, the walls are about ⅝ inch to about ¾ inch thick. The thicker walls of the improved frog add durability and strength. Manganese steel is used to increase tolerance for impact and work load imposed by the wheels of the cars of the train traversing the frog. In an embodiment, the present invention is formed from manganese poured into a casting shaped to provide the flared flangeways, reinforced sections and other features of the improved frog.

The frog of the present invention is formed such that wheel load is borne at least in part by the rail ties. The thickness of the walls of the at the heel end connector 122, 123 adds stability at the point of re-contact of the wheel of the train car to the second rail. As a consequence of these improvements, the frog supports heavier loads and lasts longer than conventional frogs.

The following example is provided to further describe the invention. One skilled in the art would readily understand that the example would similarly apply to a right hand turn, switch, other crossing, and the like.

EXAMPLE 1

Figure 4:
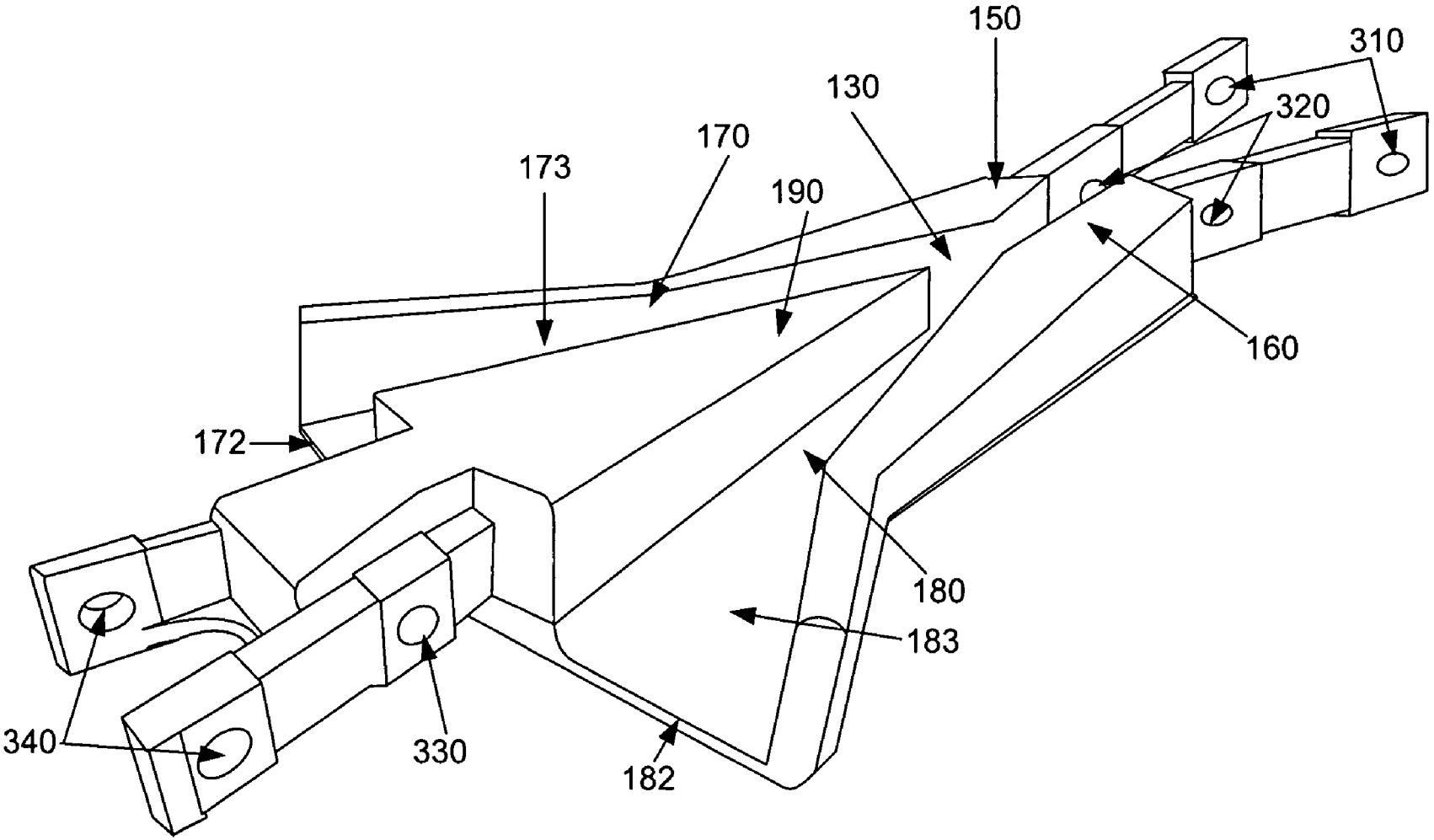
FIG. 4 is a perspective view of the frog.

In this example, a train car traveling on a first track is switched to a track that is a left turn from the direction of the first track. As the train car is moved from the first track to the second track, the front wheels of the car traverse the frog and change the direction of the car to the direction of the second track. As the fixed rear wheels of the car enter the turnout, the right hand wheel engages the frog. As shown in FIG. 4, the wheel is supported by the wing rail 160 as the wheel passes the gap at the throat 130 between the toe end connector 121 and the point 185. The flange of the wheel may optionally ride up all or part of the toe ramp 140 to enter the throat 130. As the car continues, the flange of the wheel travels flangeway 150. At the flangeway second segment 173, the wheel is supported by the point section 190 and the wheel flange brushes the flangeway wing rail wall 177 allowing the wheel supported by the point section 190 to move sufficiently toward the wing rail to allow the wheel opposite the frog wheel to maintain contact with the stock rail. The wheel re-engages the rail at the heel end connector 122. The force exerted from the frog wheel on the stock rail wheel is eased by the width and the angle of the second segment of the flangeway 173. By offsetting the force, the frog wheel is not pushed out of the frog and the train car stays on the rail through the turn.

The frog optionally works in conjunction with conventional guard railings that work on the wheel opposite the frog wheel to further aid in the prevention of derailings.

The thickness of the walls, the additional steel, and the wide flared flangeways of the present invention have greatly improved performance over conventional frogs, resulting in a savings of time and expense.

One skilled in the art will understand that the description of the present invention herein is presented for purposes of illustration and that the design of the present invention should not be restricted to only one configuration or purpose, but rather may be of any configuration or purpose which essentially accomplishes the same effect.

The foregoing descriptions of specific embodiments and examples of the present invention have been presented for purposes of illustration and description. They are not intended to be exhaustive or to limit the invention to the precise forms disclosed, and obviously many modifications and variations are possible in light of the above teachings. It will be understood that the invention is intended to cover alternatives, modifications and equivalents. The embodiments were chosen and described in order to best explain the principles of the invention and its practical application, to thereby enable others skilled in the art to best utilize the invention and various embodiments with various modifications as are suited to the particular use contemplated.

It is therefore to be understood that within the scope of the appended claims, the invention may be practiced otherwise than as specifically described herein.

What is claimed is:

1. An improved rail way frog, the improvement comprising opposite side flangeways with a predetermined length and a predetermined width, each flangeway comprising a channel and an upper surface for supporting a rail car wheel, said channel comprising a first segment and a second segment and an inner wall and an outer wall; said first segment having a first segment channel width equaling approximately a distance from the inner wall to the outer wall measured at least one point along the first segment, said second segment extending from an end of the first segment, said end positioned at a point approximately midway to a point section, said second segment having a plurality of second segment channel widths that increase in distance sequentially from a point proximate to the end of the first segment to an ending of the second segment such that the outer wall of the second segment forms a generally straight line, said second segment channel having a depth that increases from the end of the first segment to the ending of the second segment, said second segment channel width at the end of the first segment approximately equal to the first segment channel width, said ending being opposite the end of the first segment and wherein the outer wall of the second segment forms a 25 degree to a 30 degree angle with the inner wall.

2. The frog of claim 1 wherein the frog is unitarily formed of a steel.

3. The frog of claim 2 wherein the steel is manganese.

4. The frog of claim 1 wherein the second segment width at the ending is 3.5 times greater than the first segment channel width.

5. The frog of claim 1 wherein the second segment channel width at the ending is proportional to the predetermined length and the predetermined width.

6. The frog of claim 5 wherein the second segment channel width at the ending is approximately 5.5 inches.

7. The frog of claim 1 wherein the plurality of sequentially increasing second segment channel widths form a flared flangeway channel whereby a wheel of a rail way car passes through the frog.

8. The frog of claim 1 wherein the outer wall of the second segment forms a 28 degree angle with the inner wall.

9. The frog of claim 1 wherein the second segment width at the ending is three times to four times greater than the first segment channel width.

10. A method for providing an improved rail way frog, the method comprising forming the improved frog into a predetermined shape, said shape having a predetermined length and a predetermined width, said shape comprising opposite flangeways each having a channel and an upper surface for supporting a rail car wheel, said channel comprising a first segment and a second segment and an inner wall and an outer wall, said first segment having a first segment channel width, said first segment channel width equaling approximately a distance from the inner wall to the outer wall measured at least one point along the first segment, said second segment extending from an end of the first segment, said end positioned at a point approximately midway to a point section, said second segment having a plurality of second segment channel widths that increase in distance sequentially from a point proximate to the end of the first segment to an ending of the second segment such that the outer wall of the second segment forms a generally straight line, said second segment channel having a depth that increases from the end of the first segment to the ending of the second segment, said second segment channel width at the end of the first segment approximately equal to the first segment channel width, said ending being opposite the end of the first segment and wherein the outer wall of the second segment forms a 25 degree to a 30 degree angle with the inner wall.

* * * * *